United States Patent [19]

Honour, VII

[11] Patent Number: 4,507,016

[45] Date of Patent: Mar. 26, 1985

[54] MARINE RAIL SYSTEM

[76] Inventor: John H. Honour, VII, 3560 Ivy Pl., Wayzata, Minn. 55391

[21] Appl. No.: 402,089

[22] Filed: Jul. 26, 1982

[51] Int. Cl.[3] ..... B63C 3/08; B63C 5/05; B63C 13/00; B60P 3/10

[52] U.S. Cl. ..... 405/2; 405/7; 114/344; 114/375; 280/414.1

[58] Field of Search ..... 405/1, 2, 4, 7; 114/344, 366, 368, 375; 280/414.1, 414.2

[56] References Cited

U.S. PATENT DOCUMENTS

| | | | |
|---|---|---|---|
| 2,419,361 | 4/1947 | Miles | 405/2 |
| 2,529,849 | 11/1950 | Oeth | 114/344 X |
| 2,554,398 | 5/1951 | Brei | 405/1 X |
| 2,600,406 | 6/1952 | Holsclaw | 114/344 X |
| 3,058,312 | 10/1962 | McDowell | 405/2 |
| 3,285,515 | 11/1966 | Dickinson | 405/1 X |
| 3,395,544 | 8/1968 | Fisher | 405/7 |
| 3,530,518 | 9/1970 | Hall | 114/344 |
| 3,887,093 | 6/1975 | Howell | 114/344 X |

*Primary Examiner*—Cornelius J. Husar
*Assistant Examiner*—Nancy J. Stodola
*Attorney, Agent, or Firm*—Hugh D. Jaeger

[57] ABSTRACT

Marine rail system including a rail assembly of parallel ramped rails, a winch supporting a steel cable at one end, a carriage including a forward carriage and a rearward carriage with a torque tube of three members, two of the members being telescoping with respect to the third member, connecting said front and rear carriages, and the cable pulling through a front strap the front carriage as well as through a place affixed to the rear carriage through the torque tube. The torque tube provides for flexing of the front carriage and the rear carriage with respect to the watercraft as well as with respect to the rail. The guide bars as well as the length of the torque tube are adjustable to accommodate any width of beam as well as any length of watercraft. Bunk supports slide on an I-beam, providing for adjustability of the bottom of the hull, especially for V-hulled watercraft. The rail sections are in convenient lengths and secured with splicers providing for easy shipment.

7 Claims, 9 Drawing Figures

MARINE RAIL SYSTEM

BACKGROUND OF THE INVENTION

1. Description of the Invention

The present invention pertains to a marine railroad and, more particularly, pertains to a marine railway system for light- to medium-weight watercraft which utilizes V-shaped wheels.

2. Description of the Prior Art

Railroad rails which become clogged with seaweed and require extensive rail and tie-like configurations for anchoring between a boathouse, through the shoreline, and into the beach of the water. Another significant prior art problem is that the prior art marine railways have not been adjustable and are fixed to one configuration of rail as well as carriage which rides on the rails, providing little or no adjustability for different size watercraft. The prior art systems have generally been utilized in commercial-type applications, not applicable to the common lakefront or beachfront owner such as those individuals living on freshwater lakes or channels or those individuals residing on saltwater channels such as in the southern part of the country.

The prior art carriage have usually relied upon the vessel's being secured to the carriage with no guide bars for alignment of the vessel or watercraft on the carriage respectively. This has required that the vessel be appropriately placed, sometimes requiring that the individual "dive" under the vessel to make sure that the vessel is on the carriage or requires that the vessel be beached onto the carriage, which is difficult and frictional with respect to the bottom of the hull on the carriage.

The prior art systems have usually had continuous lengths of rail or rail which has been so secured such as through ties imbedded in the land, shorefront and water so as to prohibit removal of any sections.

The present invention overcomes the deficiencies of the prior art by providing an adjustable marine rail system with sections which are removable during ice shiftage, as well as a carriage which provides for adjustability as well as torquing, allowing for shifting of the carriage with respect to the watercraft supported thereon.

SUMMARY OF THE INVENTION

The general purpose of the present invention is a marine rail system providing for adjustability not only of the rail system but also of the carriage which is supported thereon. The carriage guidebars, the torque bar connecting the forward and rearward carriages, as well as the length of rail section are adjustable and are easily installed by an individual homeowner with no special tools. The person only requires simple carpentry and mechanical tools and the system can easily be installed by two individuals. The operation of the marine rail system is nothing more than the actuation of a switch providing for electromechanical action of a winch for pulling of the marine carriage up the rails while supporting a watercraft thereon. The marine rail system is intended for use by an individual homeowner, whether the home be on a lake, river or channel, whether the water be salt water or fresh water.

According to one embodiment of the present invention, there is provided a marine rail system including a rail ssembly, a winch assembly, a carriage assembly, and a watercraft supported thereon, the rail assembly including two opposing ramped rails, a plurality of stabilizer ties for supporting the forward portion of the rail assembly on land, a plurality of cross ties and support pads for supporting the rail assembly on land and through the water, and splicers for splicing any number of rail sections together, limited only by the length of the steel cable of the winch, a marine carriage including a forward and rearward carriage having V-grooved wheels with roller bearings supported on an axle secured to a front channel and a rearward I-beam, the front carriage including a mounting strap secured between the winch cable, the channel, and the front torque tube mount for pulling the front carriage, and front opposing symmetrical mirror-image guidebars supported and telescoped with engagement into a guidebar mount bolted to the front channel, a torque tube positioned between the forward torque tube mount and a rearward torque tube mount, the rearward torque tube mount supported and welded to a plate with an angular member between the rearward torque tube mount and the plate, the plate bolted to an I-beam, the I-beam supporting an axle bolted or welded thereto thereto with the V-grooved wheels with bearings, two lower rear bunk brackets with lips engaging the upper and lower sides of the horizontal portion of the I-beam, the lower rear bunk brackets supporting pivoted upper rear bunk brackets with upper wooden bunks secured thereto, and a wooden board supported and bolted across the upper portion of the I-beam for guiding the lower rear bunk brackets, and a geometrically configured rear guidebar mount for telescopically engaging rear guidebars whereby the carriage rides on the rail assembly and is pulled by the winch, the torque tube provides for horizontal as well as vertical movement with independent movement of any of the wheels with respect to each other, the rear bunk brackets are adjustable for the hull of the vessel while the forward and rear guidebars are adjustable for the forward and rear beam portions of the vessel, the number of rail sections are limited by the length of the cable and are easily spliced with respect to each other from the forward winch support, thereby providing a marine rail system for transporting a vessel from a water location to a shore or land location.

One of the significant aspects and features of the present invention is a rail system which negates the need to remove the system during the winter months and reinstall the system for the summer months. The system can remain in the water during the winter and summer months as well as supporting the vessel on land throughout the winter months as well as the summer months. The system is easily adjustable, and in the event of serious ice shifting and floe, one rail section can be removed, preferably that nearest to the water or ice, or that in the water such as unbolting the sections to prevent any possible movement during ice floes or ice thawing.

Another significant aspect and feature of the present invention is an adjustable marine rail system accommodating most size watercraft as well as any length of run between the shoreline and water. The only limiting aspect is the number of rail sections which are installed as well as the length of the cable affixed to the winch. The system is intended for use with pleasure as well as commerical vessels.

An additional significant aspect and feature of the present invention is a marine rail system which can be installed by a single individual, or preferably more than one person for purposes of easing installation upon the individual's property. The marine rail system is easily installed with simple household tools, and does not require any complex tools or any complex mechanical equipment to install same.

Having thus described the invention, it is a principal object hereof to provide a marine rail system for transporting watercraft from a water position to a land position.

One object of the present invention is to provide a marine rail system which is transportable from a manufacturer's location to an installation location where the system is packaged in a carton and easily handled by the individual consumer. The system is also easily assembled and does not require complex tools or complex installation equipment such as a crane as in the prior art systems. The system comes easily boxed in numerous packages, shippable by standard motor freight or small-package carrier, and can be laid out on a waterfront as well as in one's own yard and assembled by following the simple instruction sheets provided.

Another object of the present invention is a front carriage being low-slung with respect to the rear carriage for accommodating low water conditions and reducing the number of required rail sections. The elevated height of the rear section provides that the boat is substantially level when being pulled up the ramped rails.

BRIEF DESCRIPTION OF THE DRAWINGS

Other objects and many of the attendant advantages of this invention will be readily appreciated as the same becomes better understood by reference to the following detailed description when considered in connection with the accompanying drawings, in which like reference numerals designate like parts throughout the figures thereof and wherein.

DESCRIPTION OF PREFERRED EMBODIMENTS

Figure 1:
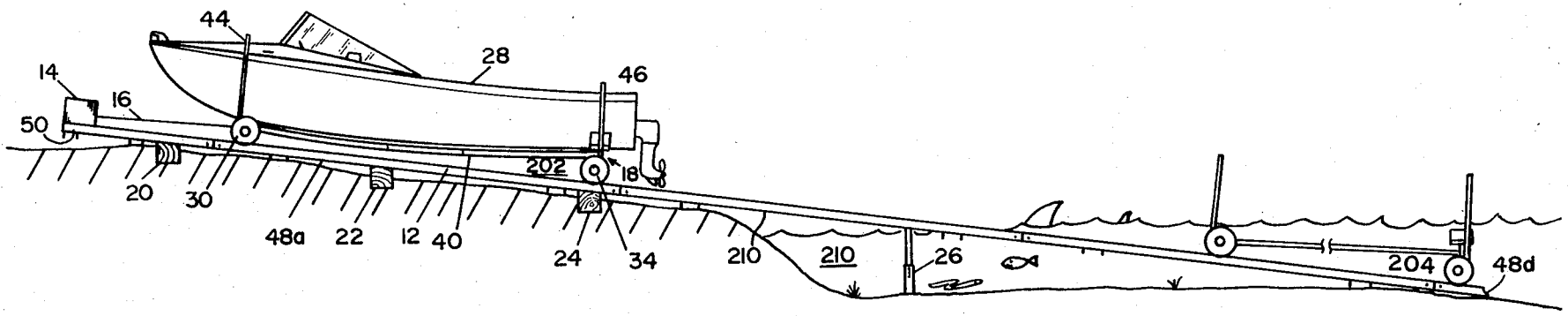
FIG. 1 illustrates a plan view of a marine rail system, the present invention.

FIG. 1 illustrates a perspective view of a marine rail system 10 including a rail assembly 12, a winch 14 attached at one end thereof with a steel cable 16 extending substantially parallel to the rail, stabilizing ties 20, 22 and 24 supporting the rail assembly 12, adjustable rail support 26, and an inboard-outboard boat or like watercraft 28 supported on the carriage 18. The carriage 18 is supported by four V-grooved wheels with inner roller bearings, wheels 30, 32, 34 and 36. Front carriage 38 connects to the steel cable 16, torque tube 40 connects between the front carriage and a rear carriage 42, and a front guide bar 44 and a rear guide bar 46 are supported by the carriages 38 and 42 respectively. The rail 12 includes five sections, each section ten feet, by way of example and for purposes of illustration only and not to be construed as limiting of the present invention, denoted as 48*a*–48*n*, as any number of rail sections could be utilized depending upon the length of the steel cable 16, and a winch section 50 for supporting the winch assembly.

Figure 2:
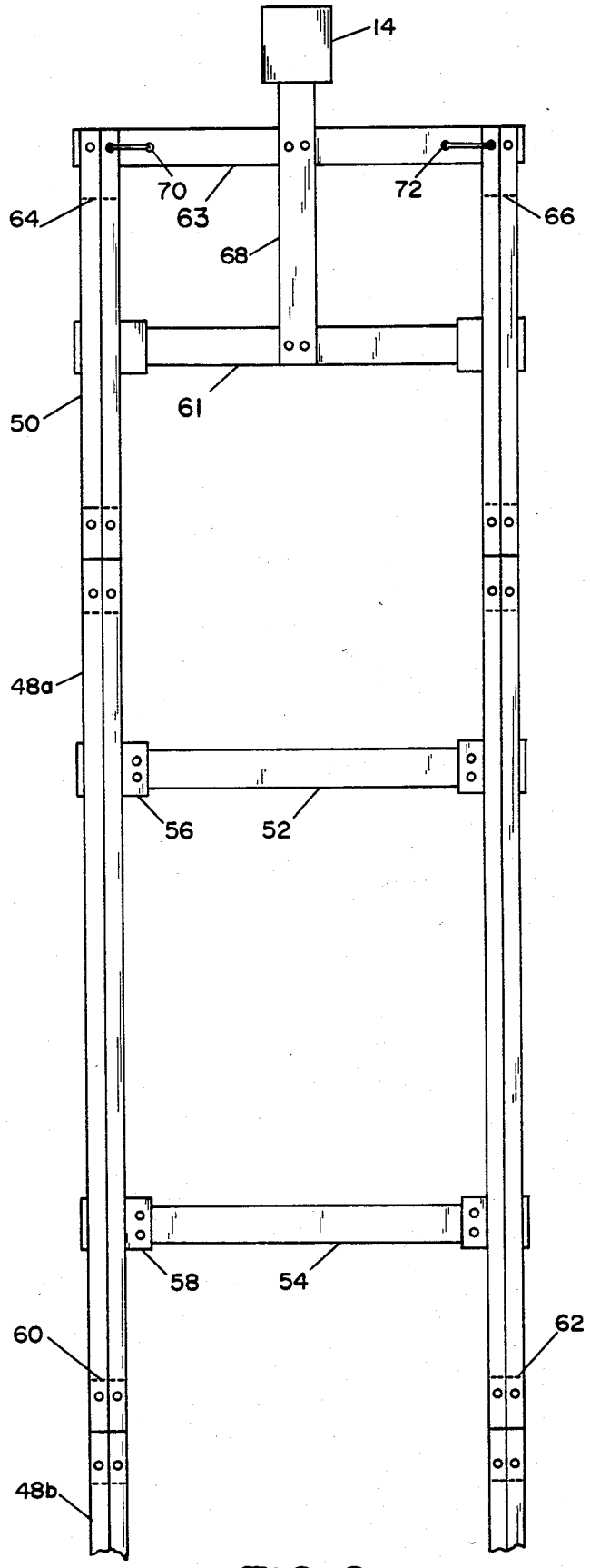
FIG. 2 illustrates a top view of the rail system.

FIG. 2 illustrates a top view of the rail assembly 12 illustrating two cross-ties 52 and 54 per each section of rail. Of course, for each section of rail there is an opposing like rail as illustrated. Each rail includes two support tabs 56 and 58, by example, which weld to the rail, and the cross ties 52 and 54 bolts to the support tabs 56 and 58. Splicers 60 and 62 bolt each of the rails together with four bolts in this example. The winch support 50 includes a standard cross tie 61, an end cross tie 63 including two end splicers 64 and 66, which are welded to the end cross tie 63, and a winch mount member 68 which bolts to the cross ties 61 and 63 and supports the winch 14 which is bolted thereto. Ties 61 and 63 are drilled for bolting of the winch mount 68. Each cross tie splicer sections 64 and 66 weld to the cross tie 63 for securing thereto. Bolts 70 and 72 provide a stop for the carriage and forward wheels 30 and 32 so as not to pull the carriage off the track.

Figure 3:
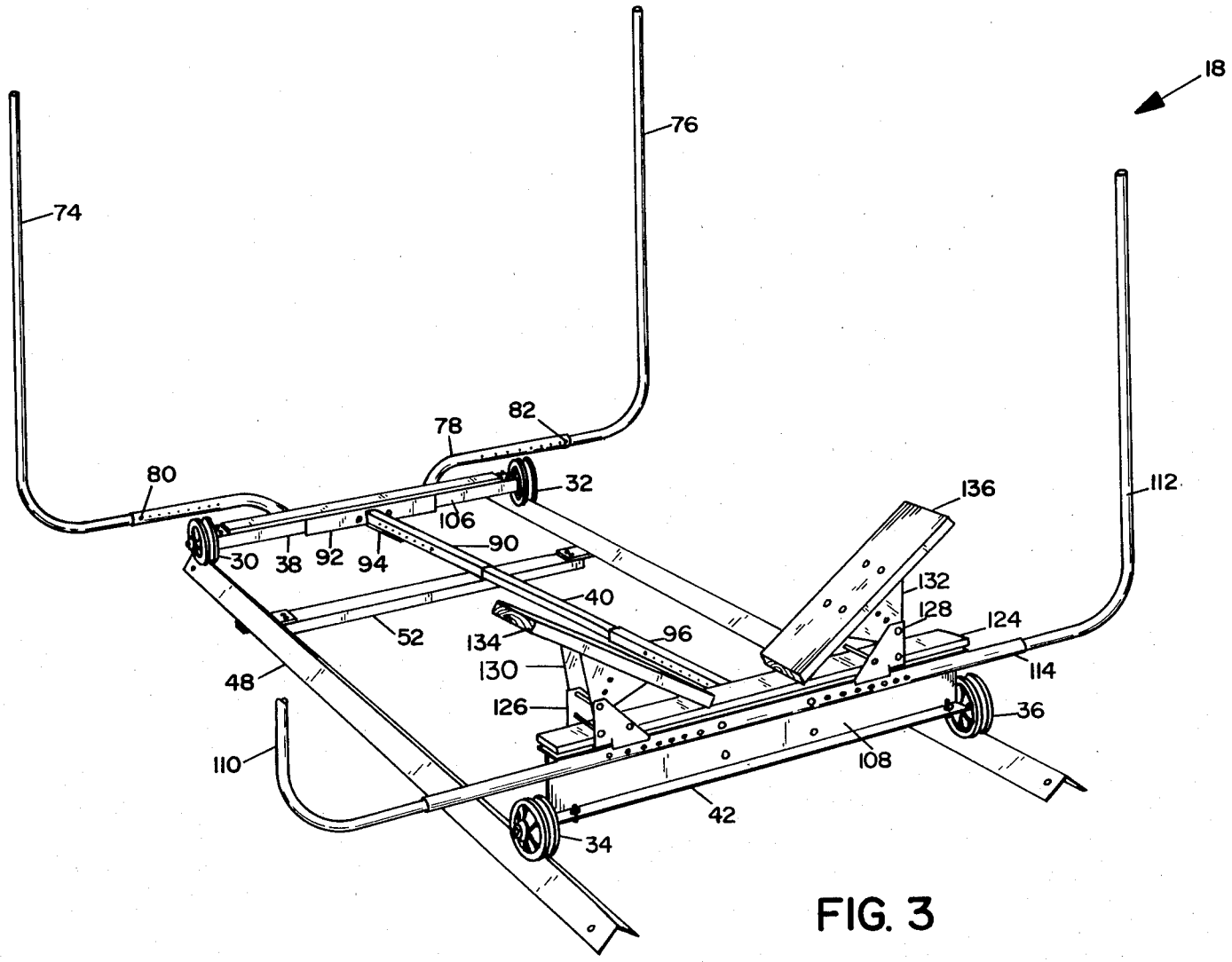
FIG. 3 illustrates a perspective view of a carriage.
Figure 4:
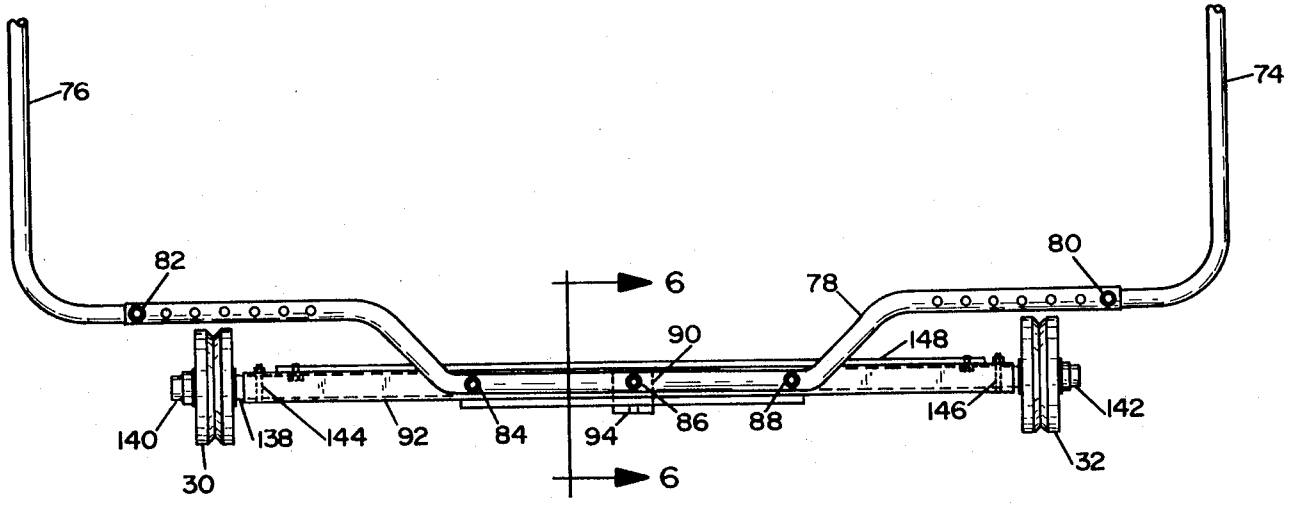
FIG. 4 illustrates a front view of a front carriage.

FIG. 3 illustrates a perspective view of the carriage 18 including the wheels 30–36, and the other components as previously described and as now described in detail. The front carriage 38 supports a geometrically configured front guide-bar mount 78, opposing symmetrical substantially vertically upward guide bars 74 and 76 which are secured to mount 78 by bolts 80 and 82. For purposes of adjustability, a plurality of holes can be provided between the engaging and telescoping ends. Guide bar mount 78 secures to the front carriage 38 with a plurality of bolts 84, 86 and 88 as illustrated in FIG. 4. The torque tube 40 includes a forward section 90 secured to a right-angle bar 92 with a flat stock 94 welded between members 90 and 92, and a rearward section 96 welded to a flat plate 98 with an angular member 100 between section 96 and 98 as illustrated in FIG. 8. Element 40 is a torque tube which telescopes with the forward torque tube mount 90, the rearward torque tube mount 96 with there being a plurality of holes in between the members and with hitch pins 102 and 104 securing the respective members as also illustrated in FIG. 8. A U-channel 106 supports the wheel assemblies with U-bolt structures, as later described in FIG. 8, and I-beam 108 supports the rear wheel assembly as later described in FIG. 7. The member 108 can be any like mechanical structure and is not limited or construed solely to an I-beam disclosure. Rear guide bar mount 114 supports rear guide bars 110 and 112, the rear guide bar mount 114 bolting with a plurality of bolts 116, 118, 120 and 122 to the I-beam with the members 110 and 112 telescoping and bolting to member 114 through the respective holes. A wooden or like member 124 bolts to the top of the I-beam 108 and supports rear bunk brackets 126 and 128 for pivoting upper rear bunk brackets 130 and 132 supporting wooden bunks 134 and 136. The wooden bunks are secured to the upper brackets by suitable nut-and-bolt assemblies. An axle 138 supports wheels 30 and 32 which are rotatably secured thereto by two compression clip pins 140 and 142. U-bolt assemblies with nuts and bolts 144 and 146 bolt the axle 138 to the channel 92. A wooden or like member 148 bolts to the top of the channel 92 for supporting a watercraft thereon.

FIG. 4 illustrated a front view of the front carriage 38 including the the front guide-bar mount 78, guide bars 74 and 76 secured to the mount 78 by bolts 80 and 82. Also, the arrangement of the flat bar 94 to the section 92 and the U shaped channel to which the right angle channel 92 couple about from the rear as illustrated in FIG. 6.

Figure 5:
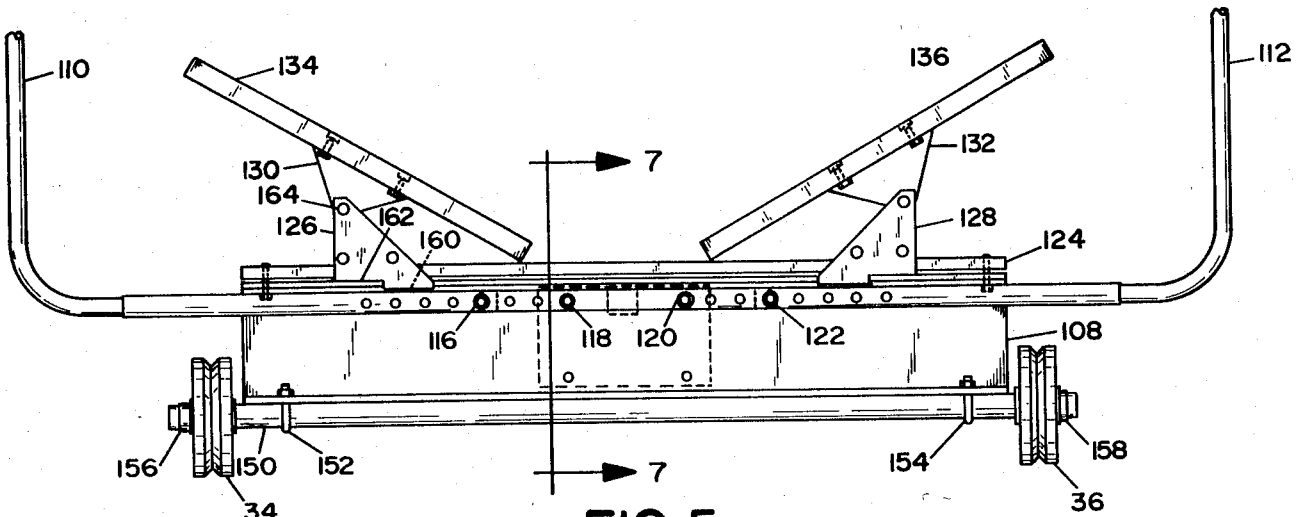
FIG. 5 illustrates a rear view of a rear carriage.

FIG. 5 illustrates a rear view of the rear carriage 42, including an axle 150 with U-bolts 152 and 154 securing the axle to the underside of the I-beam 108. Clips 156 and 158 secure the wheels to the axle 150. The brackets 126 and 128 are illustrated showing an underside lip 160 below the I-beam with a top lip 162 above the lip of the I-beam sliding therebetween. The other side of the bracket is a like mirror image and is secured in a spaced opposing relationship between the sides of the I-beam by a nut-and-bolt assembly. A pivot bolt 164 pivots the top bracket 130 with respect to the bottom bracket 126. Nut-and-bolt assemblies also support the wooden bunk on the upper bracket 130. Accordingly, brackets 128 and 132 are in a like manner to that of the opposing bracket.

Figure 6:
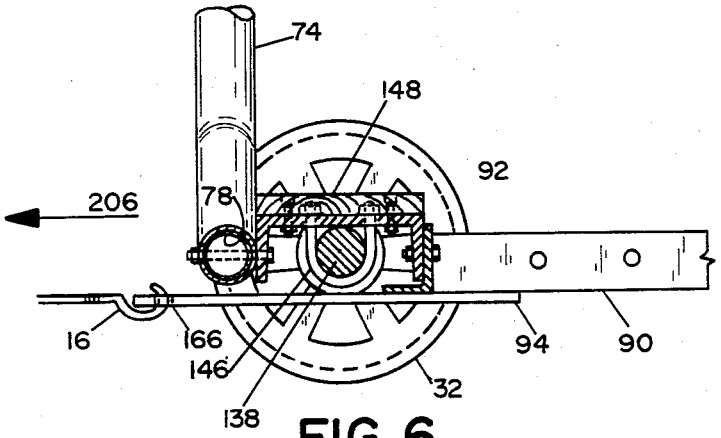
FIG. 6 illustrates a sectional view taken along line 6—6 of FIG. 4.

FIG. 6 illustrates a sectional view taken along line 6—6 of FIG. 4 where all numerals correspond to those elements previously described. Specifically, attention is pointed out that the wire cable which hooks around through a hole 166 provides for the pulling of the front carriage with action through the mounting strap 94 operating in conjunction with the right-angle channel 92 and the forward torque tube 90 provides for a pulling action of the front carriage.

Figure 7:
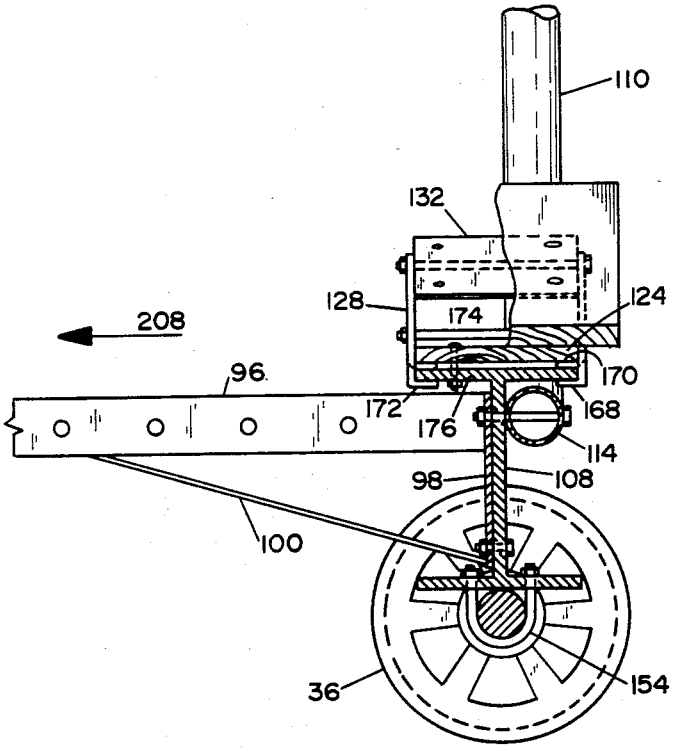
FIG. 7 illustrates a sectional view taken along line 7—7 of FIG. 5.
Figure 8:
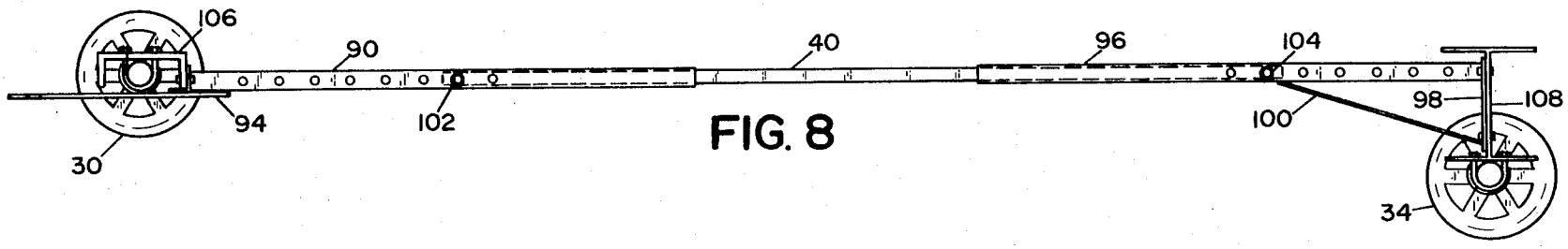
FIG. 8 illustrates a sectional view of a torque tube assembly.

FIG. 7 illustrates a sectional view taken along line 7—7 of FIG. 5 where the principle is illustrated that the rear torque tube mount 96 secured to the plate 98 with angular bracket 100 provides for a pulling of the I-beam 108. The upper bracket 132 engages and pivots within the confines of the lower bracket 128. Also illustrated are the lip positions 168 and 170 and 172 and 174 showing lower lips 168 and 172 and upper lips 170 and 174 which ride on respective portions of the I-beam and in between the wooden member 174 providing adjustability as well as securability for the rearward support of the bunks 134 and 136 with respect to the top horizontal portion 176 of the I-beam.

FIG. 8 illustrates a side view assembly of the torque tube 40 including the forward torque tube 90 and the rearward torque tube 96. The interaction between the three members provides for rotation about the longitudinal axis for adjustment of the horizontal component leveling of the rail. Torque tube also bows for the difference in planes between the top of the rear carriage, the front carriage, and the bottom of the watercraft when the watercraft is supported by the rear bunks and the forward carriage.

Figure 9:
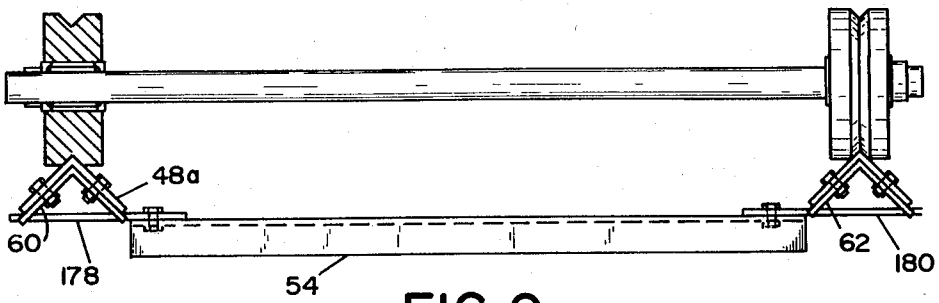
FIG. 9 illustrates a cross-sectional view of the rail assembly.

FIG. 9 illustrates a cross section of the rail assembly showing a rail section 48*a*, splicer member 60 and 62 secured thereto with bolts, and cross tie 54 which is a channel member secured to the rail support pads 178 and 180. Each rail section of course includes a symmetrical section about a center line of the rail assembly 12 for supporting a four-wheel rail type carriage 18 as known in the art.

MODE OF OPERATION

The marine rail system 10 is operated first by assembly of the rail system 12 resting on the three stabilizer ties 20–24, and with appropriate adjustable rail supports 26. The individual rail sections are assembled with the end cross tie splicers with appropriate nut-and-bolt assemblies, putting the rail sections together, and with the winch support assembly 50 supporting the winch 14. Subsequently, the wheels are positioned on the axles and secured in place, the axles secured to the rear and forward carriage assemblies, and the torque tube 40 is assembled between the front and rear torque tubes. The rail assembly 12 assumes the configuration of FIG. 2 while including the winch 14 supported on the winch support 50. The carriage assembly 18 assumes the relationship of FIG. 3 including the bunk supports 134 and 136.

FIG. 1 illustrates a watercraft 28 supported on the carriage 18, the carriage positioned on the rail assembly 12 and moved from an upper position 202 to a water position 204 by the wheels 30–36 including the V-grooves riding on the ramped section of rail as illustrated in FIG. 9.

The winch 14 unwinds the cable 16 secured to the carriage 18, resulting in pulling action of the front carriage 38 through the cable and strap 94, and pulling action of the rear carriage through the torque tubes 40, 90 and 96 of the rear carriage 42 as illustrated best in FIGS. 6 and 7 showing the pulling action by the arrows 206 and 208. In lowering the watercraft into the water 210, gravity acts against the winch and winch cables 14 and 16 respectively, only requiring unwinding while traveling in a downward manner on a slight slope 212 of the rail as illustrated in FIG. 1. In bringing the craft from a water position 204 to a land position 202, the winch cable pulls, as previously described, against gravity over the slight incline 210. The rail system requires a slight angle for operation which can be introduced through stabilizer ties and is natural to a sloping beach, but will also work with a larger angle than would normally be encountered in railway systems due to the pulling action.

FIGS. 3 and 8 illustrate the torque tube which provides for movement of any one of the wheels and readjustment to the particular position of the hull of the watercraft during the hauling operation of the boat. The torque tube allows not only for flexing of one or two of the wheels with respect to the other, but also allows for the weight of the watercraft on the cradle during the pulling operation, providing a flexible but yet substantially structurally rigid carriage 18 for supporting a watercraft 200. The guide bars 74, 76, 110 and 114 provide for positioning of the craft on the carriage when the watercraft is in the water position 204 while also providing for forward support through the guide bars 74 and 76. The rear guide bars 110 and 112 operate in conjunction with bunks 134 and 136. The telescoping action of the guide bars is illustrated in FIGS. 4 and 5.

Various modifications can be made to the present invention without departing from the apparent scope thereof. The systems is intended for pleasure watercraft as well as commerical watercraft. The length or weight of the vessel is the determining size of the structure of each of the components such as rail size, wheel size, carriage size, etc. The system is intended for fresh water as well as salt water installations.

Having thus described the invention, what is claimed is:

1. Marine rail system comprising:

a. rail means including a plurality of splicable rail sections each rail section having a ramped cross section, cross ties securing each set of rails, splicer plates splicing said rail sections together with nut-and-bolt assemblies, and a winch section for supporting a winch including a steel cable, stabilizer ties supporting said winch section and rail section on land; and, b. carriage means including a forward carriage and a rearward carriage, and torque tube means interconnecting between adjustable center portions of said forward carriage and said rearward carriage and including a forward torque tube of rectangular cross section mount affixed to said forward carriage and a rearward torque tube of rectangular cross section mount affixed to said rearward carriage and a torque tube of rectangular cross section therebetween, each of said torque tubes, said forward and said rearward torque tube mounts including a plurality of holes for adjustability and securing by hitch pins, strap means secured between said winch cable and said torque bar means, telescoping adjustable guide bar means secured to said forward carriage and to said rearward carriage, each of said guide bar means including a geometrically configured lower section, substantially vertical upright guide bars telescoping and engaging within opposing ends of said geometrically configured lower section, each of said telescoping ends including a plurality of holes, nut-and-bolt assemblies secured through one of said plurality of holes for securing said upright guide bars to said lower section, said forward carriage including a planar bunk member thereacross, bracket means positioned on an upper portion of said rearward carriage and slidably adjustable for adjustment along a horizontal length of said rearward carriage, said bracket means including two opposing lower rear bunk brackets, two opposing upper rear bunk brackets pivoted to said lower rear bunk brackets respectively by a bolt means, lower and upper lips of said lower rear bunk brackets engaging about a horizontal portion of an I-beam of said rearward carriage, and wooden bunk pads secured to each of said upper bunk brackets by bolt means, and wheel means including V-grooved wheels with bearings secured to an axle, said axle secured to each of said forward and rearward carriages, said V-grooves engaging with ramped edge of said rail system whereby said carriage is pulled into a water position from a land position by gravity through said winch cable and pulled from a water position to a land position against gravity by said winch cable, said carriages adjustable in length by said torque tube means and in width for accepting a watercraft by said guide bar means, and in bunk means by said adjustable bunk bracket means for accepting a V-hull or like vessel, and said torque tube is flexible for accommodating differences in said rail height or gull differences, providing for flexing about said torque tube means, thereby providing a carriage which is pivotable about the horizontal as well as the vertical axis during hauling of the watercraft which rests on said carriages and above said torque tube.

2. System of claim 1 including a mounting strap connected to said forward torque tube mount, and a right-angled plate secured to said front carriage whereby said steel strap pulls said right-angled plate and said forward torque tube mount which likewise pulls said torque tube and said rearward torque tube mount.

3. System of claim 1 wherein said rearward torque tube mount secured to a plate, said plate bolted to said rearward carriage, and an angular strap secured between said rearward torque tube mount and said plate.

4. System of claim 1 wherein said rail sections are right-angled members at a 45° angle with respect to each cross tie.

5. System of claim 1 wherein said winch secures to a winch member, said winch member secures to cross ties, said cross ties supporting said winch section, and said winch mounted forward to said end winch cross tie.

6. System of claim 1 wherein said rail section includes at least two cross tie opposing mounting pads on opposing rails of each of said section, said cross ties secured thereto with nut and bolt assemblies, and and said splicer sections secured to each end of each of said rail.

7. System of claim 1 comprising at least one winch section and two rail sections.

* * * * *